US005492356A

United States Patent [19]

Astier et al.

[11] Patent Number: 5,492,356

[45] Date of Patent: Feb. 20, 1996

[54] INTERFACE DEVICE BETWEEN A SKI AND BINDINGS

[75] Inventors: Lionel Astier, Seynod; Jean-Pierre Clement, Annecy-le-Vieux; Francois Guers, Annecy, all of France

[73] Assignee: Salomon S.A., Chavanod, France

[21] Appl. No.: 149,737

[22] Filed: Nov. 10, 1993

[30] Foreign Application Priority Data

Nov. 27, 1992 [FR] France ..... 92 14481

[51] Int. Cl.[6] ..... A63C 5/07

[52] U.S. Cl. ..... 280/602; 280/607

[58] Field of Search ..... 280/602, 607, 280/618, 636

[56] References Cited

U.S. PATENT DOCUMENTS

| | | | |
|---|---|---|---|
| 4,896,895 | 1/1990 | Bettosini | 280/607 |
| 4,995,630 | 2/1991 | Piegay | 280/602 |
| 5,211,418 | 5/1993 | Scherubl | 280/602 X |
| 5,242,188 | 9/1993 | Bigler et al. | 280/607 X |
| 5,251,923 | 10/1993 | Stepanek et al. | 280/602 |
| 5,385,364 | 1/1995 | Nussbaumer | 280/607 |

FOREIGN PATENT DOCUMENTS

| | | | |
|---|---|---|---|
| 0182776 | 5/1986 | European Pat. Off. | 280/602 |
| 0409749 | 1/1991 | European Pat. Off. | 280/602 |
| 0437172 | 7/1991 | European Pat. Off. . | |
| 564767 | 10/1993 | European Pat. Off. . | |
| 3934888 | 5/1990 | Germany . | |
| 9102551.6 | 7/1991 | Germany . | |
| 4100327 | 7/1991 | Germany | 280/607 |
| 83/03360 | 10/1983 | WIPO . | |
| 86/04824 | 8/1986 | WIPO . | |
| 9312845 | 7/1993 | WIPO | 280/607 |

*Primary Examiner*—Brian L. Johnson

*Attorney, Agent, or Firm*—Pollock, Vande Sande & Priddy

[57] ABSTRACT

An interface device between a ski (1) and bindings (3, 4) designed to hold in place the ends of a ski boot on a ski. The device comprises a longilinear plate (15) which extends above the ski, in the runner area. One end of the plate (15) is connected to the ski by a linkage (17, 18, 19) which permits this end to slide freely in relation to the ski. A stop blocks this sliding motion beyond a determinate ski flexion. The other end of the plate is connected to the ski by a linkage (30, 33, 31) which can become deformed longitudinally by elastic stretching. This linkage is constituted by a glue layer (33) which exhibits both adhesive and stretching properties.

4 Claims, 2 Drawing Sheets

INTERFACE DEVICE BETWEEN A SKI AND BINDINGS

FIELD OF THE INVENTION

The invention concerns an interface device between a ski and front and rear bindings designed to hold a ski boot supported on the ski.

BACKGROUND OF THE INVENTION

A ski boot is normally held supported on the ski by means of a front and a rear binding, each of which holds an end of the boot sole. Conventionally, the bindings are assembled directly on the upper ski surface.

It is known, moreover, that the ski boot and the bindings affect the flexibility of the beam of the ski and its performance on the snow. This ski performance on snow is, furthermore, different depending on the type of skiing practiced, i.e., slalom, downhill, giant slalom, etc., and on the size of the skier. In addition, it is known that the performance of a ski is assessed in different phases of skiing, and, in particular, in the turn-release and ski-control phases.

Attempts have been made to produce different kinds of interfaces, which are placed between the bindings and the ski, so as to modify the effect that the bindings and the ski boot produce on the beam which constitutes the ski.

For example, Patent No. WO 82/03182 discloses an interface device which tends to attenuate the effect produced by the bindings and the ski boot, so that the ski when flexed exhibits a uniform curve, which is as close as possible to its curvature in its unfitted state.

Other interface devices are also known, which play a more active role regarding ski performance. A device of this kind is disclosed in Patent Application No. WO 83/03360. This device comprises a plate, on which the bindings are mounted. An elastically-compressible material is placed beneath this plate. One end of the plate is solidly attached to the ski, and the other end can slide freely against the elastic return force of small blocks of a compressible material.

This device yields good results, but does not distribute the pressure generated by the ski on the snow in optimal fashion in the different phases of skiing, i.e., in the release and control phases. Furthermore, the distribution of pressure does not change as a function of ski flexion.

Another interface device is disclosed in Patent No. EP 409 749. In this device, the plate can swing elastically longitudinally in relation to the ski. This device also yields good results; its disadvantage lies in the fact that the plate is not connected longitudinally to the ski by a direct support, but by elastically-compressible supports. The ski boot thus wobbles in relation to the ski. Nor does the action of this device change as a function of ski flexion.

SUMMARY OF THE INVENTION

It is an object of the invention to propose an interface device between a ski and bindings which improves the distribution of ski pressure on the snow, in particular to improve ski performance in the phases of turn-release and steering.

Another object of the invention is to propose an interface device which reacts to changes in ski flexion.

Another object of the present invention is to propose an interface device which dampens ski flexion in a vertical and longitudinal plane.

Other objects and advantages of the present invention will emerge during the following description.

The interface device according to the invention is positioned between a ski and front and rear bindings intended to hold the ends of a ski boot in place, the bindings being positioned in a central area of the ski called the runner, and each of which comprises a base for attachment to the ski.

The device incorporates a longilinear plate, each of whose ends is connected to the ski in front of and behind the bindings, the plate having, toward one of its ends, an mounting area designed to attach a binding, called the first binding, one so-called "first" end of the plate being assembled longitudinally to the ski by an elastically-deformable linkage.

The device is characterized by virtue of the fact that the other, so-called "second" end of the plate is attached to the ski by means of a linkage allowing this second end to slide freely longitudinally in relation to the ski, and by the fact that a first stop restricts the relative motion of the second end of the plate in the direction of the corresponding end of the ski, within a clearance limit specified for a determinate flexion of the ski in the direction of a depression of the area of the runner in relation to at least one of the ends.

BRIEF DESCRIPTION OF THE DRAWINGS

The invention will be better understood with reference to the following description and to the attached drawings forming an integral part of this description, and in which.

DESCRIPTION OF THE PREFERRED EMBODIMENT

Figure 1:
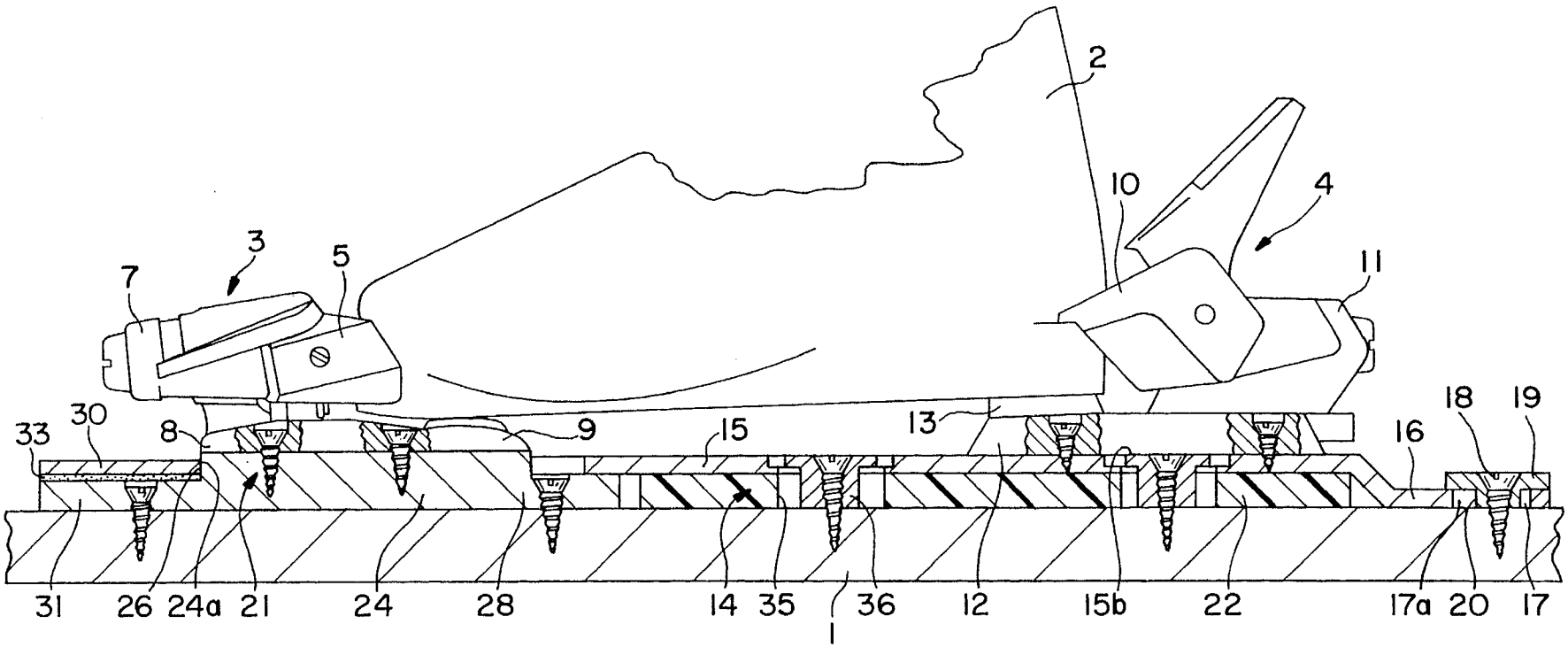
FIG. 1 is a side and cross-sectional schematic view in different planes of the runner area of a ski equipped with an interface device and binding according to a first embodiment of the invention.
Figure 2:
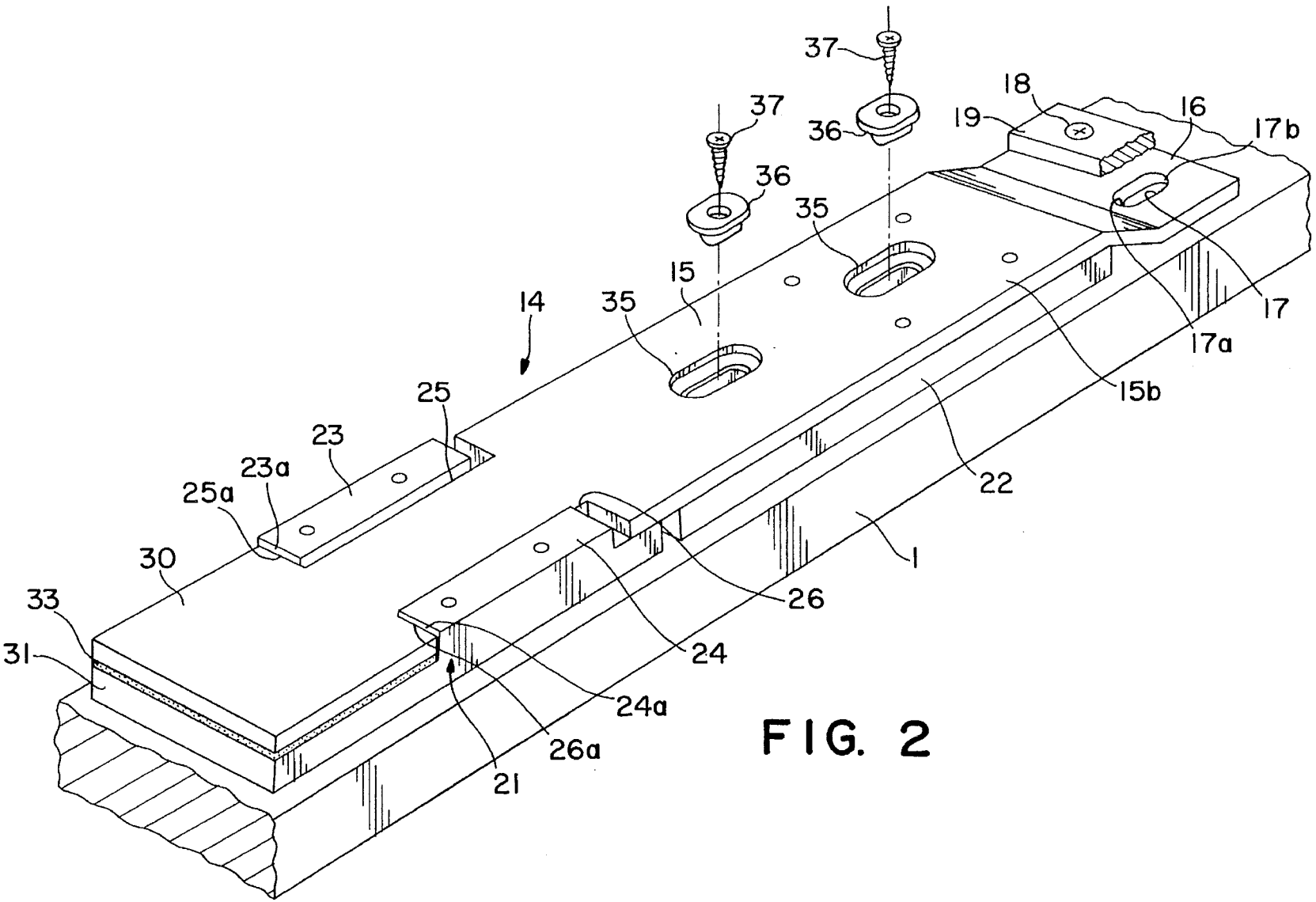
FIG. 2 is a perspective view of the device in FIG. 1, without the bindings.

FIG. 1 shows the middle portion of the ski 1, usually termed the runner. In this area, a ski boot 2 is held supported on the ski 1 by a front binding 3 and a rear binding.

In conventional fashion, the front binding 3 has a jaw 5 holding the front end of the boot in place. The jaw 5 is carried by a body 7 connected to the ski by means of a base 8. As can be seen in FIG. 1, the base 8 is extended rearward by a support plate 9 on which the front part of the boot sole rests.

In similar fashion, the rear binding 4 incorporates a jaw 10 which holds the rear end of the boot in place and which is carried by a body 11. The body 11 is, in turn, joined to the ski by means of a base. The front portion of base 12 has a support plate 13 on which the rear end of the boot sole rests. Conventionally, the body may slide along the base 12 toward the rear, against the return force of a spring, termed the recoil spring.

The bindings 3 and 4 are connected to the ski 1 by an interface device 14, to be described below in greater detail.

The interface device 14 comprises mainly a longilinear plate 15 extending between the bindings and the ski, in the runner area of the latter. The plate is rigid and is made from any suitable material, e.g., aluminum or a composite material.

According to the embodiment illustrated, the plate 15 is elevated above the upper ski surface, over the greater part of its length. In its rear portion, it has a stepped down end 16, which skiis the upper ski surface. The plate 15 is assembled to the ski in the area of its end 16 located to the rear of the rear binding, by means of a connection permitting the end to slide freely longitudinally on the upper surface of the ski. During ski flexion, the sliding motion of the end of the plate in relation to the ski is directed toward the rear of the ski. According to the invention, a stop blocks the sliding motion of the plate in relation to the ski, beyond a determinate amplitude of motion corresponding to a determinate degree of ski flexion.

In the embodiment illustrated, the plate 15 has, at its end 16, two oblong orifices 17 extending longitudinally of the ski. Screws 18 supported by a cap 19 extend through these orifices 17. The cap is preferably equipped with barrels 20 which pass through the oblong orifices 17 and whose height is slightly greater than the thickness of the end 16 of the plate, so as to leave a slight degree of vertical play.

An anti-friction plate is potentially placed between the end 16 of the plate and the upper ski surface, so as to facilitate the sliding motion in this area.

The screws 18 and the barrels 20, by cooperating with front ends 17*a* of the oblong orifices 17, form a stop which limits the relative sliding motion of the plate rearward during ski flexion. At rest, the screws and the barrels 20 are preferably located in the central part of the oblong holes.

According to the embodiment illustrated, the base 12 of the rear binding 4 is solidly fastened to the plate in the assembly area 15*b*, which is designed for that purpose. A layer of an elastically-compressible material 22 is preferably interposed between the plate and the upper ski surface. This layer extends at least beneath the base 12 of the rear binding 4, and, in the example illustrated, extends forward in the direction of the front binding. This layer dampens vertical stresses being propagated between the rear end area of the boot. The material making up this layer 22 preferably exhibits viscoelastic-type dampening properties.

The plate 15 extends forward beyond the front binding 3. Moreover, the binding 3 is connected to the ski by means of a block 21 attached to the ski, and to which the binding 3 is assembled by its base 8.

The block 21 is firmly attached to the ski using any suitable means, e.g., screws. It consists of two main parts, i.e., a part 8 supporting the base 8 of the front binding, and a part which supports and guides the plate 15. In the example shown, the binding-support part comprises two lateral studs 23 and 24, on which the base 8 of the binding rests. The height of the studs 23 and 24 is slightly greater than the thickness of the plate 15 at this spot, so as to allow the plate to slide freely between the studs. Furthermore, the length of the studs is sufficient to support simultaneously the base 8 of the binding and the support plate 9 on which the boot rests.

The studs 23 and 24 extend through the thickness of the plate at the location of the openings 25 and 26, whose length exceeds that of the studs.

Between the studs 23 and 24 and to the rear of the latter, the block 21 has a base 28 which supports the plate 15 in a downward, vertical direction. Moreover, the plate is guided laterally between the studs 23 and 24.

Accordingly, it is a direct support mechanism which supports the front end of the boot vertically on the ski. This support configuration is direct with respect to all downward stresses which the front end of the boot exerts on the ski, and, in particular, purely vertical stresses, as well as the stresses corresponding to a rolling movement of the boot in relation to the ski. In this way, there is an effective transmission of the steering stresses that the boot imparts to the ski.

The front part of plate 15 is connected to the ski by an elastically-deformable linkage along the longitudinal direction defined by the ski. In the example illustrated, the front end 30 of the plate 15 is held in a raised position off the upper ski surface. It overhangs a support 31 attached firmly to the upper ski surface, and which is advantageously constituted by the front portion of the block 21.

A layer 33 of glue is formed between the lower surface of the end 30 of the plate and the upper surface of the support 31. This glue can also be added between the studs 23 and 24. The glue used has adhesive elastic deformation properties, in particular as regards shearing stress. In fact, the layer 33 acts as a longitudinally-oriented damper. The material preferably exhibits viscoelastic properties. Good results have been obtained using a layer of a glue whose thickness approaches 2 millimeters.

Accordingly, a relative longitudinal motion is made possible between the end 30 of the plate and the support 31. This motion causes the glue layer 33 to stretch longitudinally. The glue opposes resistance to this relative motion of the end 30 in relation to the ski. In reaction, the resistance that the glue opposes to the relative motion of the plate generates a moment of forces transmitted to the front of the ski, and which tends to cause the ski to dip toward the snow when the end 30 moves forward. This moment of forces becomes increasingly stronger as the end 30 becomes increasingly raised in relation to the ski, because of the support 31.

Preferably, a stop obstructs the relative motion of the end of the plate 30 in relation to its support, when a longitudinal motion is directed toward the rear of the ski. This stop is advantageously formed by the front faces 23*a*, 24*a* of the studs 23 and 24, which cooperate with the front edges 25*a*, 26*a* of the openings 25 and 26. Accordingly, when the ski is at rest, this stop holds back the plate 15, which would otherwise tend to move backward under the effect of the thrust which the recoil spring exerts during skiing on the body of the rear binding.

According to the aforementioned description, it will be understood that, during ski flexion in the direction in which the runner becomes depressed in relation to at least one of the ends of the ski, the interface device functions in two stages. In a first stage, in the case of slight ski flexion, the rear end of the plate 15 moves rearward in relation to the screws 18. If flexion increases and attains a significant amplitude, the screws 18 are stopped on the front part 17*a* of the oblong holes 17; then the front part of the plate moves forward in relation to the block 21, against the force of resistance generated by the glue layer 33. When flexion stops, the ends of the plate are brought back toward their initial position.

During ski flexion, the front and rear bindings 3 and 4 tend to draw closer together, but the sole of the ski boot opposes this movement. The body of the binding moves backward against the return force of the recoil spring. In reaction, the return force of the recoil spring acts against the plate 15 and the block.

Accordingly, when flexion ceases, the recoil spring pushes the plate back toward the rear, until it is stopped again against the pins 23 and 24, thereby facilitating its return motion.

The interface device behaves in two different ways depending on ski flexion and on whether or not the screws 18 are stopped against the ends 17*a* of the oblong holes 17.

The switch from one mode of functioning to the other may be made gradual by placing blocks of an elastically-compressible material, which act as shock absorbers, or any other suitable means, into the oblong holes. In addition, by virtue of the position of the screws 18 or barrels 20 in relation to the ends 17*a* of the oblong holes 17, it is possible to control the amplitude of the ski at which the shift is made from one mode of functioning to the other. For example, different caps 19 can be used, with oblong barrels of different lengths, or blocks can be inserted into the oblong holes 17.

It should be pointed out that, during flexion of this kind, the boot maintains direct force of support on the ski vertically and downward, in the area of the support plate. In addition, the plate becomes supported directly, longitudinally and horizontally, against a stop fastened to the ski. The front portion of this stop is constituted by the front faces of the studs 23 and 24 and the front edges 25*a*, 26*a* of the openings and the rear portion, by the fastening screws 18 and the front ends 17*a* of the oblong holes 17. Under reverse flexion, the rear part of the plate moves in relation to the screws 18. On the other hand, the front end of the plate does not exert shearing stress on the layer 33, since it is stopped against the studs 23, 24.

The central portion of the plate 15 preferably incorporates at least one oblong orifice 35 through which a flanged washer 36 extends. A screw 37 attaches the flanged washer 36 to the ski. This assembly allows longitudinal movement of the plate, but prevents the central portion from being raised off the upper surface of the ski, and prevents lateral motion of the plate.

It is also possible to mount the interface device in the other direction on the ski, so that the linkage connecting the plate to the ski slides freely so as to reach the front part of the plate, and the plate linkage is positioned in its rear portion, through the action of an elastically-deformable mechanism.

What is claimed is:

1. Interface device between a ski (1) and front and rear bindings (3, 4) designed to hold the ends of a boot in place, said bindings being positioned in a central runner portion of said ski and each comprising a base (8, 12) connecting said binding to said device, said device comprising a longilinear plate (15) having front and rear ends respectively connected to said ski forwardly and rearwardly of said bindings (3, 4), said plate (15) having at said rear end (16), a first assembly area for attachment of said rear binding (4), said front end (30) of said plate (15) being attached longitudinally to a support by an elastically-deformable linkage, wherein (a) said rear end (16) of said plate is connected to said ski by a linkage (17, 18, 19) permitting said rear end to slide freely longitudinally in relation to said ski,and a first stop assembly (18, 17*a*) limits relative motion of said rear end in a direction of a corresponding end of said ski, within a limit of clearance determined for predetermined flexure of said ski in the 18 direction of a depression of said central portion in relation to at least one of said front and rear ends;

(b) a second stop assembly (23*a*, 25*a*, 24*a*, 26*a*) obstructs the relative motion of said front end (30) of said plate in relation to said ski, in a direction of relative distancing of said front end of said plate from a corresponding end of said ski;

(c) said front end (30) of said plate (15) is connected to said ski by a layer (33) of an adhesive material which is elastically-deformable in the longitudinal direction defined by said ski; and (d) said plate (15) incorporates a block (21) which is attached to said ski and is equipped with a second assembly area (23, 24) which receives said attachment of said base (8) of said front binding (3), said block (21) being positioned on a side of said front end of said plate and constituting said second stop (23*a*, 25*a*, 24*a*, 26*a*).

2. Device according to claim 1, wherein said front end (30) of said plate (15) is elevated in relation to an upper surface of said ski.

3. Device according to claim 1, wherein said second end (16) of said plate (15) incorporates longitudinally extending oblong orifices (17) through which extend screws (18) engaged solidly in said ski, said screws (18) being mounted, when said ski is at rest, in central portions of said oblong orifices, and one end (17*a*) of said oblong orifices forming said first stop which limits said relative motion of the first end of the plate in relation to the ski.

4. Device according to claim 1, wherein a second end (16) of said plate is the end directed toward the rear of the ski, and a first end (30) is the end directed toward the front of the ski.

* * * * *